United States Patent [19]

Cenky

[11] Patent Number: 4,825,187

[45] Date of Patent: Apr. 25, 1989

[54] THERMAL CUTOFF

[75] Inventor: Mark A. Cenky, Lexington, Ohio

[73] Assignee: Therm-O-Disc, Incorporated, Mansfield, Ohio

[21] Appl. No.: 118,021

[22] Filed: Nov. 6, 1987

[51] Int. Cl.[4] ..... H01H 37/76

[52] U.S. Cl. ..... 337/407; 337/408; 337/409; 174/50.61

[58] Field of Search ..... 337/407, 408, 409; 200/284; 174/50.61, 152 GM

[56] References Cited

U.S. PATENT DOCUMENTS

| | | | |
|---|---|---|---|
| 4,246,561 | 1/1981 | McVey | 337/407 |
| 4,401,965 | 8/1983 | Backlund et al. | 337/407 |
| 4,411,061 | 10/1983 | Clapper et al. | 337/407 |

*Primary Examiner*—H. Broome

*Attorney, Agent, or Firm*—Jones, Day, Reavis & Pogue

[57] ABSTRACT

A thermal cutoff including a dielectric bushing having opposite ends and a hole therethrough. A wire lead received through the hole has an enlarged contact thereon adjacent one bushing end, and an enlarged deformation thereon adjacent the other bushing end. The contact and deformation prevent relative longitudinal movement between the bushing and lead.

7 Claims, 1 Drawing Sheet

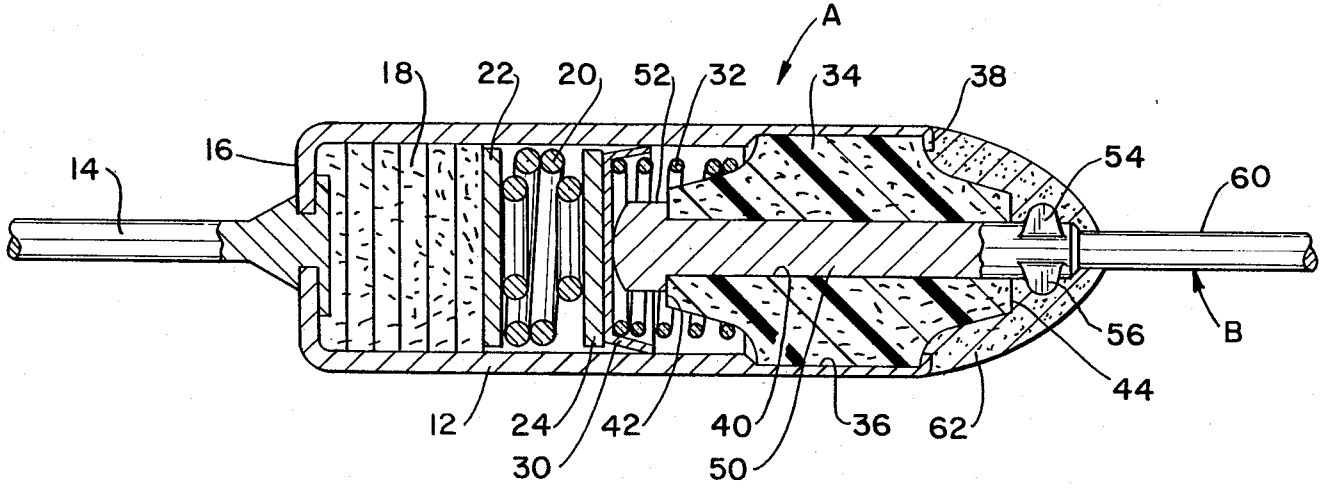
60
B
54
56
44
38
62
A
34
36
32
40
50
52
42
20
24
30
22
12
18
16
14

THERMAL CUTOFF

BACKGROUND OF THE INVENTION

This application relates to the art of thermal protectors and, more particularly, to thermal protectors for interrupting an electrical circuit in the event a predetermined temperature is reached or exceeded. The invention is particularly applicable to thermal cutoffs, and will be described with specific reference thereto. However, it will be appreciated that the invention has broader aspects, and can be used with thermal protectors of other types.

A thermal protector of a known type includes a dielectric bushing received in an open end of a housing. A hole through the bushing receives a wire lead having an enlarged contact on one end inside the housing. The lead has a tail portion extending outwardly from the bushing outside of the housing. A sealing compound surrounds the tail portion of the lead adjacent the bushing, and also covers the outside end of the bushing. Under some conditions, the bond between the sealing compound and tail portion of the lead can become loose, and result in movement of the lead through the bushing further into the housing. This may result in undesirable and dangerous reclosing of open contacts in a thermal cutoff whose design temperature has been reached or exceeded. It would be desirable to have a more positive way of preventing relative longitudinal movement between the bushing and the lead.

SUMMARY OF THE INVENTION

A thermal cutoff of the type described has an enlarged deformation on the tail portion of the lead adjacent the outer end of the bushing. The enlarged contact and enlarged deformation substantially prevent relative longitudinal movement between the bushing and lead. Thus, the bushing and lead are mechanically locked to one another against relative longitudinal movement.

In a preferred arrangement, that portion of the lead which extends through the bushing hole has a diameter substantially larger than the lead tail portion beyond the enlarged deformation. The larger diameter portion of the lead extending through the bushing hole allows economical forming of a larger fixed contact for better heat dissipation, and better redistribution of lead material. The enlarged diameter lead portion also enables economical formation of the enlarged deformation without seriously weakening the lead.

The improved bushing and lead assembly of the present application is preferably used in a thermal cutoff of the type having a thermal pellet that melts when the design temperature of the cutoff is reached or exceeded. Melting of the pellet causes opening of normally closed contacts to interrupt a circuit in which the cutoff is connected.

It is a principal object of the invention to provide an improved thermal cutoff.

It is also an object of the invention to provide an improved arrangement for locking a lead to a bushing.

It is a further object of the invention to provide an improved manner of mechanically locking a lead to a bushing in a thermal cutoff.

It is an additional object of the invention to provide a thermal cutoff with a lead which can be economically deformed to provide a larger fixed contact and an enlarged deformation that lock the lead against longitudinal movement relative to a bushing.

BRIEF DESCRIPTION OF THE DRAWING

The drawing shows a thermal cutoff having the improved lead and bushing assembly of the present application incorporated therein.

DESCRIPTION OF THE PREFERRED EMBODIMENT

Referring now to the drawing, wherein the showings are for purposes of illustrating a preferred embodiment of the invention only, and not for purposes of limiting same, a thermal protector in the form of a thermal cutoff A includes an elongated cup-like cylindrical metal housing 12. A wire lead is suitably attached to one end 16 of housing 12 in a known manner.

A thermal pellet 18 of an organic chemical is positioned within housing 12 against end 16. Thermal pellet 18 is solid at normal operating temperatures, and melts when the design temperature of the thermal cutoff is reached or exceeded. The thermal pellet can be made from many different organic chemicals having different melting temperatures, examples of which include caffeine and animal protein.

A compressed coil spring 20 is positioned within housing 12 between metal discs 22, 24. Disc 24 engages a metal star contact 30 having a plurality of circumferentially-spaced outwardly inclined resilient fingers resiliently engaging the interior of housing 12 in sliding conductive relationship therewith. A second coil spring 32 acts between star contact 30 and a dielectric bushing 34 of ceramic or the like.

Housing 12 has an open end portion with a cylindrical recess 36 of a diameter larger than the remainder of housing 12. Bushing 34 is closely received in recess 36, and terminal end portion 38 of housing 12 is deformed inwardly over bushing 34 for locking same within recess 36. A central cylindrical hole 40 extends through bushing 34 between opposite ends 42, 44 thereof.

An elongated wire lead B extends through bushing hole 40. Main lead portion 50 that extends through bushing hole 40 has an enlarged diameter, and is closely received through bushing hole 40. An enlargement 52 on one end portion of wire lead B defines a fixed electrical contact, and has transverse dimensions substantially larger than the diameter of bushing hole 40. The enlarged diameter portion 50 of wire lead B extends outwardly beyond bushing end 44 a sufficient amount to allow formation of an enlarged deformation thereon. In the arrangement shown, the enlarged deformation is in the form of opposite outwardly extending wings 54, 56 located closely adjacent bushing end 44. Wings 54, 56 are formed by flattening wire lead B so that the transverse dimension of lead B across wings 54, 56 is substantially greater than the diameter of bushing hole 40. Preferably, the entire diameter of wire lead B is not deformed so that the central portion thereof between wings 54, 56 remains of the full diameter to provide adequate strength.

A reduced diameter lead tail portion 60 extends outwardly beyond wings 54, 56 to provide a flexible lead for connection in an electrical circuit. The enlarged deformation defined by wings 54, 56 may be spaced slightly from bushing end 44 to prevent damage to the bushing when forming the deformation. This may result in limited relative longitudinal movement between bushing 34 and lead B. However, relative longitudinal movement between the two is substantially blocked.

A suitable sealing compound 62, such as epoxy or the like, is positioned in surrounding relationship to wire lead B around wings 54, 56. Sealing compound 62 also completely covers bushing end 44 and housing terminal end portion 38. The sealing compound bonds to all of the surfaces it engages. The enlarged deformation defined by opposite wings 54, 56 also provides an enhanced mechanical interlock between sealing compound 62 and wire lead B.

Thermal cutoff A has spring 20 with a greater biasing force than spring 32 so that star contact 30 and fixed contact 52 are normally closed. When the design temperature is reached or exceeded, thermal pellet 18 melts and allows spring 20 to expand so that its biasing force becomes substantially less than the biasing force of spring 32. Star contact 30 then moves to the left in the drawing away from fixed contact 52 to open the circuit. In the event the bond between sealing compound 62 and wire lead B becomes broken, wire lead B cannot move from right to left in the drawing to re-establish contact between fixed contact 52 and star contact 30 because the enlarged deformation defined by wings 54, 56 prevents such movement. In previous arrangements without the mechanical interlock provided by the enlarged deformation, it was possible for wire lead B to move axially through bushing hole 40 to re-establish contact.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. In a thermal cutoff including a housing having an open end, a dielectric bushing received in said housing open end, said bushing having opposite ends and a hole therethrough, an electrical lead closely received through said hole and having an enlarged contact thereon within said housing adjacent one of said bushing opposite ends, a deformation on said lead adjacent the other of said bushing opposite ends, both said contact and deformation being substantially larger than said hole for stepping relative axial movement between said bushing and lead, said lead comprising a length of wire having a nominal diameter the same as the portion of said lead extending through said bushing hole, and said wire being substantially reduced in diameter beyond said deformation to define a flexible lead tail portion.

2. The cutoff of claim 1 including sealing compound surrounding and bonded to said deformation and said other bushing end.

3. A bushing and lead assembly comprising a dielectric bushing having opposite ends and a hole therethrough, said hole opening outwardly at said opposite ends of said bushing, an electrical lead having a lead bushing portion closely received through said hole, an enlarged electrical lead contact on said lead bushing portion adjacent one of said bushing opposite ends, a deformation on said lead bushing portion adjacent the other of said bushing opposite ends, both said contact and said deformation being larger than said hole for preventing relative axial movement between said bushing and lead, said lead having a flexible free connector portion beyond said deformation, and said lead bushing portion having a substantially larger diameter than said lead free connector portion.

4. The assembly of claim 3 including a housing having an open end receiving said bushing with said lead contact inside said housing and said deformation outside said housing, and sealing compounding surrounding said deformation in bonded relationship to said lead, said other bushing end and said housing.

5. The assembly of claim 4 including a movable contact normally biased into engagement with said lead contact, a meltable thermal pellet operative when solid to maintain said movable contact biased into engagement with said lead contact and operative when melted to allow movement of said movable contact away from said lead contact.

6. The assembly of claim 3 wherein said deformation comprises a flattened portion of said lead bushing portion providing outwardly extending opposite wings.

7. The assembly of claim 3 wherein said lead bushing portion extends outwardly beyond said other of said bushing opposing ends just sufficiently to allow formation of said deformation thereon and said flexible free connector portion of said lead begins just beyond said deformation.

* * * * *